United States Patent [19]

Brady

[11] Patent Number: 5,035,451

[45] Date of Patent: Jul. 30, 1991

[54] DISTURBANCE RESPONSIVE MAGNETIC LATCH

[76] Inventor: Robert D. Brady, 921 Pigeon Point Rd., Pescadero, Calif. 94060

[21] Appl. No.: 600,189

[22] Filed: Oct. 17, 1990

[51] Int. Cl.[5] ..... E05C 19/02

[52] U.S. Cl. ..... 292/96; 292/DIG. 22; 292/201

[58] Field of Search ..... 292/87, 96, 122, 144, 292/201, 251.5, DIG. 22

[56] References Cited

U.S. PATENT DOCUMENTS

| | | | |
|---|---|---|---|
| 1,939,487 | 12/1933 | Brainard | 292/122 X |
| 3,599,743 | 8/1971 | Hull | 292/216 X |
| 4,552,399 | 11/1985 | Atarashi | 292/DIG. 22 X |
| 4,576,541 | 3/1986 | Dunn et al. | 292/122 X |

*Primary Examiner*—Richard E. Moore
*Attorney, Agent, or Firm*—Jeffrey Hall

[57] ABSTRACT

A disturbance responsive magnetic latch comprises a latch arm having spring legs and mounted onto a first substantially planer mounting surface for engaging a door or door frame member. A screw or other fastening mechanism may be used to attach said first mounting surface and latch arm to the door. A second mounting surface is provided having a magnet coupled thereto and having a retainer for retaining and securing the latch arm thereto. The magnet is preferably of a substantially flat and elongated construction. The second mounting surface is secured to a predetermined area distant from the first base plate preferably by a screw or other mechanical fastening mechanism.

18 Claims, 2 Drawing Sheets

DISTURBANCE RESPONSIVE MAGNETIC LATCH

BACKGROUND OF THE INVENTION

1. Field of the Invention

The present invention relates to safety locks for doors. More specifically, the present invention relates to a disturbance responsive magnetic latch for mounting on cabinet doors which is responsive to vibrations, shaking, and other disturbances such as those encountered in seismic events, moving vehicles, boats, and the like.

2. Description of Prior Art

Numerous latching devices have been proposed and implemented for securing cabinets, windows, and doors in a closed position. Such latching devices are set to be in either a locked or an unlocked position. As such, these devices do not provide for protection against sudden vibrations or movement caused by earthquakes or other seismic events, for example, when conventional latches are often dislodged from their locked position and the contents scattered and in many cases destroyed. Abrupt and sudden disturbances are also often encountered in vehicles such as airplanes, automobiles, motor homes, boats, and the like. In such situations conventional approaches to latching doors is often inadequate to protect against such disturbances often with disastrous results. Furthermore, such latches, since they are either in an on or locked position at all times are not useful as a backup safety latches. Two such devices may not be used in combination with each other in order to provide a backup or safety feature because either both will be in the locked position and thus interfering with normal usage of the doors, or if one is locked and the other left unlocked there is no backup or safety function achieved, and if both are left unlocked there is no protection whatever and in fact the doors will remain open.

A search of the prior art did not disclose any patents that read directly on the claim of the instant invention, however, the following U.S. Patents were considered related;

U.S. Pat. No. 4,848,812 issued to Slaughter, July 18, 1989

U.S. Pat. No. 4,452,475 issued to Bloch et al, June 5, 1984

U.S. Pat. No. 3,844,597 issued to Elrod et al., Oct. 29, 1974

U.S. Pat. No. 3,635,511 issued to Waller, Jan. 18, 1972

U.S. Pat. No. 3,388,938 issued to Peterson, June 18, 1968

U.S. Pat. No. 3,312,492 issued to Remhof, Apr. 4, 1967

U.S. Pat. No. 2,971,789 issued to Weaver, Feb. 14, 1961.

Slaughter discloses a concealed safety lock having a magnetic bolt disposed within a throughbore of the device. This device was used in either an on or locked position or an open or unlocked position. No means were provided which could activate the locking mechanism by sudden motion or other disturbances and thus such device was severely limited in use and application as either a backup safety latch or as a latch responsive to sudden vibrations or other disturbances.

Bolch et al. show a door with a magnetic sealing strip as a latching device. Such device prevented the opening or unlatching of the door due to sudden motion, however, it was not activated by such motion and as such was, when activated, always in a locked position.

The Waller, Remhof, and Weaver patents all disclose latching devices of a genre where magnets are used to lock a latch in a closed position. None show a device which is activated or locked by sudden movements. Nor are any of these patents useful as a backup or as a safety latch The remaining prior art disclose mechanical devices to latch doors or lids shut and are included for illustration and are representative of the art to which this invention relates.

It would be very desirable therefore to have a disturbance responsive latch which is activated by vertical or horizontal motion such as that encounter in earthquakes, moving vehicles, boats, and the like. It would also be desirable to have such latch which could be used in combination with conventional latches without interfering with their function or the normal opening and closing of the door.

It is therefore an object of the present invention to provide a disturbance responsive latch mechanism which is responsive to vertical and horizontal shaking or rocking motions for securing cupboard doors and the like.

SUMMARY OF THE INVENTION

The present invention is a novel and improved latching device which is sensitive and responsive to vertical and horizontal shaking, rocking, or vibrational motion and activated by the same. The latch includes a latch arm operably secured to a pivot pin and secured to a first substantially planar mounting surface for engaging the door or door frame member. Means are included for securing the mounting surface to the door. A second mounting surface is provided having a magnet coupled thereto and having retainer means for retaining the latch arm thereto. The magnet may be pad shaped of a substantially flat and elongate configuration. Means are provided for securing said second mounting means to a cabinet or cabinet frame member. The latch further includes means for coupling said second mounting surface to the door or to a door frame member.

The latch is mounted typically to the inside of the door. The two mounting plates are operably spaced so that when the door is closed the latch arm is in a rearmost or unlatched position. If a sudden motion or disturbance occurs the door moves slightly towards an open position and the latch arm moves into the proximity of the magnet and into its magnetic field. The latch arm becomes firmly secured to the magnet, and as the door move further open the latch arm slips into retaining means and the door is prevented from opening further. The latch is very sensitive to horizontal motion traverse to the door, which is the critical direction of door movement during an earthquake, for example, as well as vertical motion due to shaking, rocking, or vibrational motion. Deactivation of the latch is accomplished by simply closing the door to a completely shut position. This will detach the latch arm from the retainer and move it past the magnetic field thus allowing the latch arm to fall to its normal or open position.

DRAWING REFERENCE NUMERALS

Figure 1:
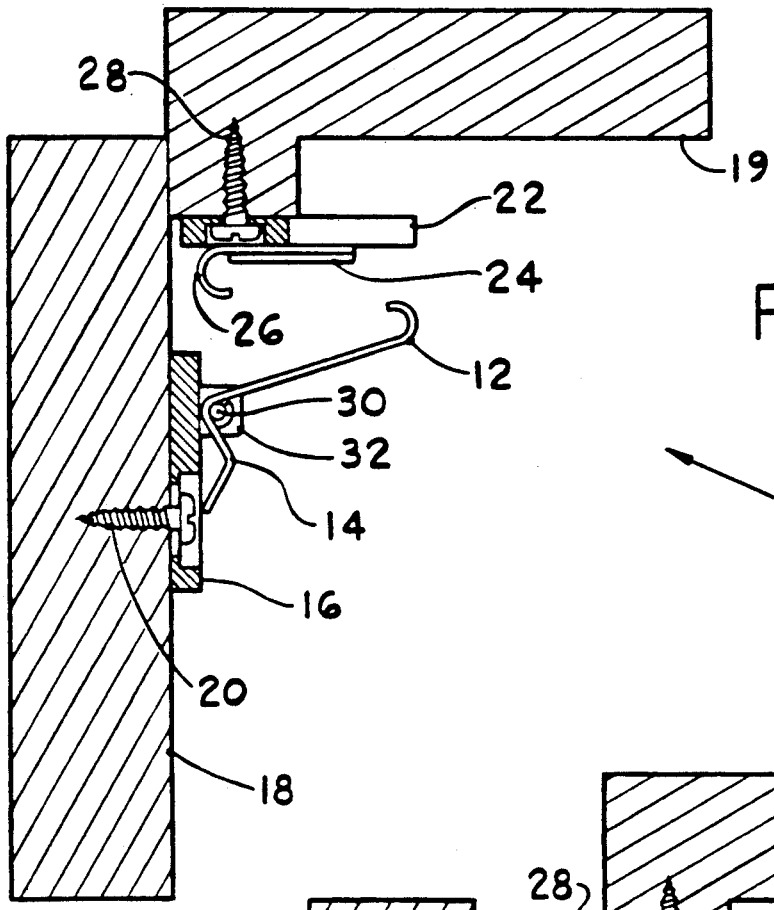
FIG. 1 shows a side elevational view of a disturbance responsive magnetic latch according to the invention.

10: disturbance responsive magnetic latch
12: latch arm
14: spring legs of latch 12
15: rolled attachment flap of latch 12
16: base plate/mounting means for latch arm portion
18: door
19: cabinet or cabinet frame member
20: screw
21: adjustment slot for screw 20
22: base plate/mounting means for retainer portion
24: magnet
26: retainer
28: screw
30: pivot pin
32: support shoulder for pivot pin 30
33: hole for screw 28.

DETAILED DESCRIPTION OF THE PREFERRED EMBODIMENT

FIG. 1 shows a disturbance responsive magnetic latch 10 according to the preferred embodiment of the invention. The latch comprises a latch arm 12 operably secured to pivot pin 30 by means of rolled flap 15. The latch arm 12 is secured to a first substantially planer base plate 16 which is mounted onto a door or door frame member 18. A pivot pin 30 is housed in support shoulder 32 and is pivotally linked by rolled flap 15 which may be integral or separate from latch arm 12. Mounting means for base plate 16 are provided by screw 20, however, other conventional mechanically fastening means may also be used. Screw 20 is secured in adjustment slot 21. By varying the position of base plate 16 on door 18 and locking into position by screw 20 a means for precise and incremental adjustment of latch arm 12 is provided.

Figure 2:
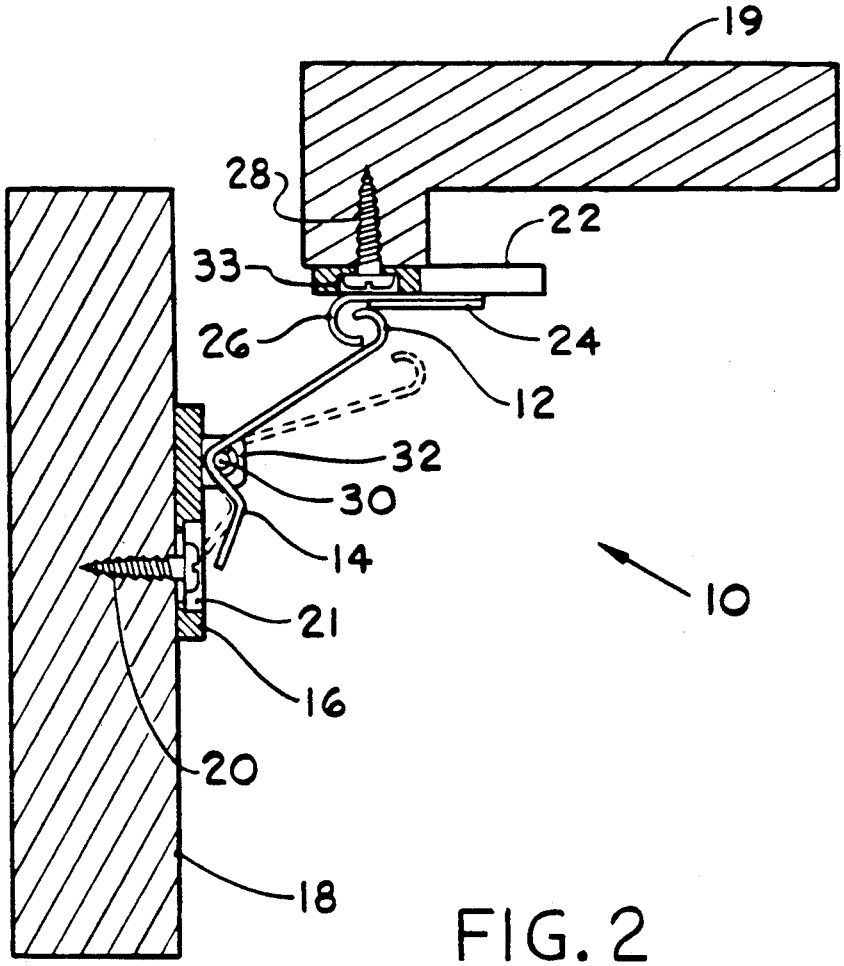
FIG. 2 shows a side elevational view of such latch showing the latch arm secured by the retainer according to the invention.

A second mounting surface 22 having a magnet 24 coupled thereto and a retainer 26 operably secured thereon is mounted on to a cabinet or frame member 19 by screw 28 or other conventional fastening means at a predetermined position separate from base plate 16. As shown in FIG. 2 latch arm 12 is secured by retainer 26 when latch arm 12 is moved or shaken by a disturbance and attracted to magnet 24 on the second mounting surface 22.

Figure 3:
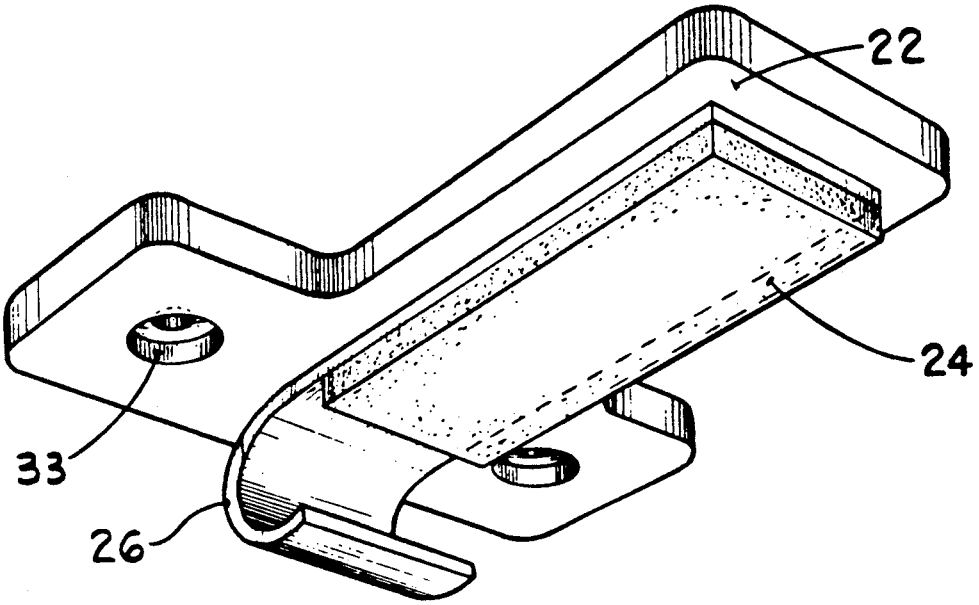
FIG. 3 shows a bottom perspective view of the retainer portion of such latch according to the invention.

Referring to FIG. 3 magnet 24 and retainer 26 ar shown detached from a door. It is apparent that a wide variety of magnets differing in shape and magnetic strength may be used depending upon the application in which latch 10 is used. Furthermore, retainer 26 may be constructed in a variety of shapes corresponding to different embodiments of hooked end of latch arm 12.

Figure 4:
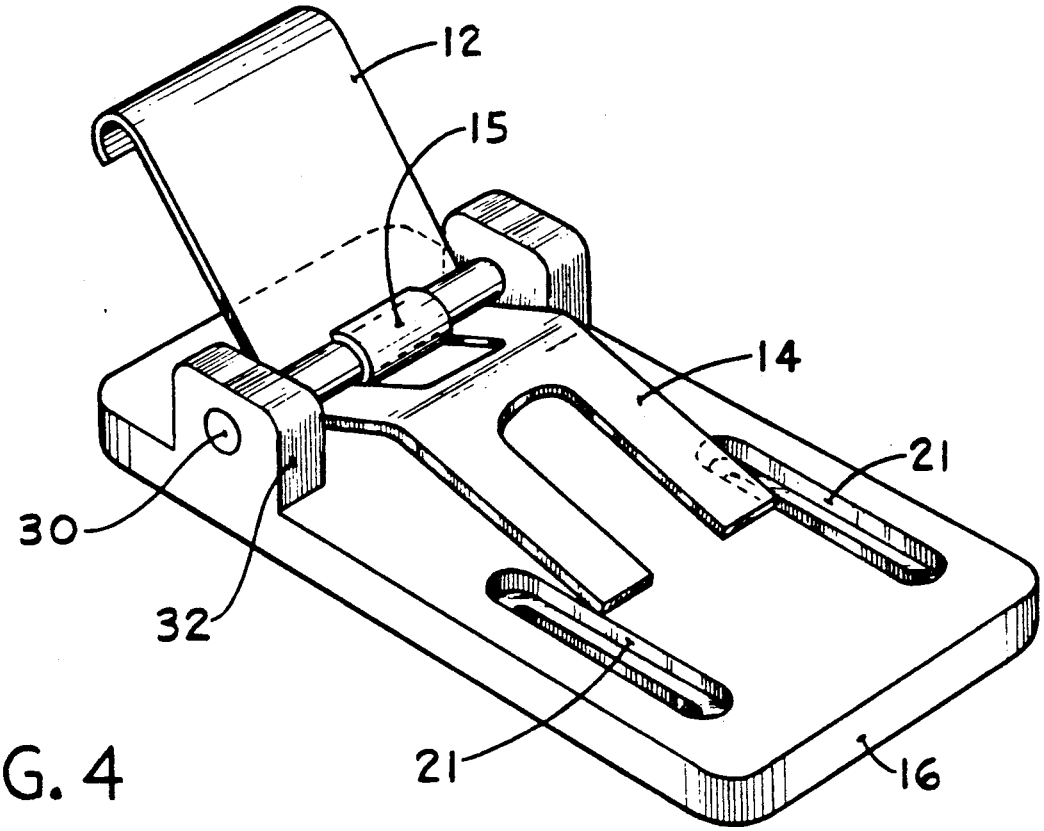
FIG. 4 shows a front perspective view of the latch arm portion of such latch according to the invention.

The first base plate 16 which is preferably of a flat elongated construction is illustrated detached from a door or door frame member in FIG. 4. Shoulder 32 secures pivot pin 30 which in turn pivotally supports latch arm 12 by rolled flap 15 in a disturbance responsive coupling. Latch arm 12 preferably is hooked at one end as shown in FIG. 4.

Base plates 16 and 22 may, in an alternative embodiment be secured to a door or door frame member by means of adhesives. Retainer 26 is preferably hooked at one end as illustrated in FIG. 3 but may, in an alternative embodiment be replaced by a ratchet, nipple, shouldered pin, or equivalent latching means.

Preferably the disturbance responsive latch 10 is composed of a thermoplastic or similar durable material but may be otherwise. The latch 10 is preferably manufactured by injection molding, however, many alternative manufactures well known in the art may also be utilized.

In operation and use base plate 16 attaches to a cabinet door or other hinged member. In the event of a disturbance such as an earthquake or other seismic event which causes the cabinet to shake spring legs 14 will move up and down in accentuated vibration. That is, small vibrations from the earthquake or other disturbance will be accentuated by the spring legs 14 of latch 12 best seen in FIG. 4. The corresponding retainer 26 on the second mounting surface 22 is secured to the cabinet and when latch arm 12 is moved in an upward direction from the accentuated vibrations, it is attracted and secured by magnet 24 which will hold it in an imminent interlock position. If the door is moved further in the outward direction, the latch arm 12 will be retained by retainer 26 and the door will be held in place thereby preventing spillage of the contents of the cabinet. Magnet 24 also functions to hold, while allowing movement of latch arm 12 prior to engagement with retainer 26, in position for interlocking with retainer 26 thereby preventing vibrations of the door or cabinet from pulling latch arm 12 away from its imminent interlock with retainer 26.

Deactivation of the latch is accomplished by simply closing the door to a full shut position. This will move the latch arm 12 past the zone of magnetic attraction and allow latch arm 12 to detach from retainer 26 and magnet 24 and fall to its normal, or open, position.

While the above description contains many specificities, they should not be construed as imitations on the scope of the invention, but merely as exemplifications of preferred embodiments thereof. Those skilled in the art will envision many other possible variations are within its scope. For example the disturbance responsive magnetic latch of the invention could include machine controlled or machine de-activated components, for example, responsive to off-balance vibrations or eccentric vibrations. The latch of this invention could also be applied in many different applications, for example, in recreational or marine vehicles, or in aeronautical applications. In such application the latch could be set to respond only to sudden, unexpected disturbances, such a when the vehicle or craft has been landed, moored, or parked. The latch may be composed of alternative materials such as plastics or wood, and various configurations and designs, for example, one or more latch arms, may be successfully utilized for the base plate or hooking mechanisms. Those, skilled in the art will recognize that permutations of base plate 12 and base plate 22 will allow for attachment of disturbance responsive magnetic latch 10 to cabinets or enclosures 19 which are partially inset or fully inset doors. Also different embodiments of base plate 22 will allow attachments of disturbance responsive magnetic latch 10 to the vertical side members of a cabinet or enclosure opening. Accordingly, it is requested that the scope of the invention be determined by the appended claims and their legal equivalents, and not by the examples which have been given.

I claim:

1. A disturbance responsive magnetic latch for selectively locking or unlocking a cabinet or other enclosure, comprising:

a first substantially planer mounting surface for engaging a face of said door, a latch arm operably coupled to a pivot pin and having spring legs integral therewith and being coupled to said first planar mounting surface, means for securing said first mounting surface to said cabinet or enclosure frame member, a second mounting surface having a magnet coupled thereto and having retainer means in a normally non-latching relationship between said latch arm and said retainer means so that a disturbance or motion causes magnetic attraction to place the latch arm in a position to engage the retainer means when the door is moved to open, and means for securing said second mounting surface to said cabinet or enclosure member.

2. The disturbance responsive magnetic latch of claim 1 wherein said means for securing said latch arm further comprises a hook at one end thereof.

3. The disturbance responsive magnetic latch of claim 1 wherein said means for securing said first mounting surface comprises a screw.

4. The disturbance responsive magnetic latch of claim 1 wherein said means to secure said first mounting surface comprises adhesives.

5. The disturbance responsive magnetic latch of claim 1 wherein said magnet is of a flat elongate construction.

6. The disturbance responsive magnetic latch of claim 1 wherein said retainer means comprises a hook shaped element.

7. The disturbance responsive magnetic latch of claim 1 wherein said means for said second mounting surface comprises a screw.

8. The disturbance responsive magnetic latch of claim 1 wherein said means for securing said second mounting surface comprises adhesives.

9. The disturbance responsive magnetic latch of claim 1 wherein said latch is composed of plastic.

10. A motion responsive magnetic latch for selectively locking a cabinet door to a cabinet in response to movement of said cabinet door, comprising:

a first planer mounting surface for engaging a face of said cabinet door, a latch arm operably linked to a pivot pin and having spring legs integral therewith and being operably secured to said first planar mounting surface, means for securing said first mounting surface to said cabinet door, a second mounting surface secured to said cabinet and having a magnet coupled thereto for attracting said latch arm, retainer means secured to said second mounting surface for retaining said latch arm in a normally non-latching relationship between said latch and said retainer means so that disturbance or motion causes magnetic attraction to place the latch arm in a position to engage the retainer means when the door is moved to open thereby limiting movement of said door in response to sudden or abrupt movements, means for securing said second mounting surface to said cabinet.

11. The motion responsive magnetic latch of claim 10 wherein said latch arm further comprises a hook at one end thereof.

12. The motion responsive magnetic latch of claim 10 wherein said means for securing said first mounting surface comprises a screw.

13. The motion responsive magnetic latch of claim 10 wherein said means for securing said first mounting bracket comprises adhesives.

14. The motion responsive magnetic latch of claim 10 wherein said magnet is of a flat elongate construction.

15. The motion responsive magnetic latch of claim 10 wherein said retainer means comprises a hook shaped element.

16. The motion responsive magnetic latch of claim 10 wherein said means for securing said second mounting surface comprises screws.

17. The motion responsive magnetic latch of claim 10 wherein said means for securing said second mounting surface comprises adhesives.

18. The motion responsive magnetic latch of claim 10 wherein said latch is composed of plastic.

* * * * *